US006805512B2

(12) United States Patent
King

(10) Patent No.: US 6,805,512 B2
(45) Date of Patent: Oct. 19, 2004

(54) FLUID DISPENSER

(76) Inventor: Patricia Anne King, 2037 S. Fundy Ct., Aurora, CO (US) 80013

( * ) Notice: Subject to any disclaimer, the term of this patent is extended or adjusted under 35 U.S.C. 154(b) by 0 days.

(21) Appl. No.: 10/064,811

(22) Filed: Aug. 20, 2002

(65) Prior Publication Data

US 2004/0037613 A1 Feb. 26, 2004

(51) Int. Cl.[7] ..... A46B 11/04; B43K 5/14; B43M 11/06

(52) U.S. Cl. ..... 401/270; 401/134; 401/133; 401/153; 401/183

(58) Field of Search ..... 401/290, 183, 401/184, 185, 186, 153, 156, 132, 133, 134, 135; 222/92, 95, 206, 211, 542

(56) References Cited

U.S. PATENT DOCUMENTS

| | | | | | |
|---|---|---|---|---|---|
| 1,026,010 | A | | 5/1912 | Watanabe | |
| 1,258,677 | A | | 3/1918 | Haskell | |
| 1,935,639 | A | | 11/1933 | Keeshan | 15/134 |
| 1,945,957 | A | | 2/1934 | Salmon | 15/133 |
| 2,051,340 | A | | 8/1936 | Lomas | 15/136 |
| 2,104,651 | A | | 1/1938 | Hoffman, Jr. | 132/73 |
| 2,467,570 | A | | 4/1949 | Ward | 132/74.5 |
| 2,480,718 | A | * | 8/1949 | Donato | 401/185 |
| 2,520,605 | A | | 8/1950 | Maynier | 15/140.4 |
| 2,894,541 | A | | 7/1959 | Marban | 141/30 |
| 2,945,252 | A | | 7/1960 | Martineau, Jr. | 15/136 |
| 3,073,319 | A | | 1/1963 | Sperber | 132/73 |
| 3,261,367 | A | | 7/1966 | Pickering | 132/84 |
| 3,300,808 | A | | 1/1967 | Karl | 15/604 |
| 3,341,884 | A | | 9/1967 | Pryor | 15/523 |
| 3,400,996 | A | * | 9/1968 | Vandergrift | 401/184 |
| 3,592,202 | A | | 7/1971 | Jones | 132/88.7 |
| 3,739,779 | A | | 6/1973 | Pfleger | 128/218 DA |
| 3,969,028 | A | | 7/1976 | Negreiros | 401/279 |
| 4,056,213 | A | * | 11/1977 | Stern | 222/95 |
| 4,296,071 | A | | 10/1981 | Weiss et al. | 73/864.11 |
| 4,309,119 | A | | 1/1982 | Wittersheim | 401/188 R |
| 4,447,169 | A | | 5/1984 | Vartoughian | 401/269 |
| 4,470,715 | A | | 9/1984 | Reuchlin et al. | 401/115 |
| 4,593,690 | A | | 6/1986 | Sheridan et al. | 128/207.15 |
| 4,640,637 | A | | 2/1987 | Winthrop | 401/101 |
| 4,726,386 | A | | 2/1988 | Schultz | 132/79 B |
| 4,747,419 | A | | 5/1988 | Flynn et al. | 132/73 |
| 4,940,351 | A | | 7/1990 | Konose | 401/278 |
| 4,944,625 | A | | 7/1990 | Futter et al. | 401/153 |
| 5,066,157 | A | | 11/1991 | Liff | 401/288 |
| 5,154,523 | A | | 10/1992 | Devreeze | 401/144 |
| 5,186,563 | A | | 2/1993 | Gebard et al. | 401/153 |
| 5,301,381 | A | | 4/1994 | Klupt | 15/22.1 |
| 5,395,278 | A | | 3/1995 | Dickhut | 446/486 |
| 5,462,377 | A | | 10/1995 | Martinez, Jr. et al. | 401/185 |
| 5,518,331 | A | | 5/1996 | Moosmann et al. | 401/230 |
| 5,570,966 | A | | 11/1996 | Phelan | 401/183 |
| 5,975,088 | A | | 11/1999 | Stehman | 132/74.5 |
| 6,056,470 | A | | 5/2000 | Nehashi et al. | 401/279 |
| 6,070,595 | A | | 6/2000 | Baltierra | 132/200 |
| 6,176,632 | B1 | | 1/2001 | Kageyama et al. | 401/186 |
| 6,241,412 | B1 | | 6/2001 | Spies et al. | 401/129 |
| 6,402,410 | B1 | | 6/2002 | Hall et al. | 401/146 |

OTHER PUBLICATIONS

Squeeze Jet, Product Identification for model IDM 7500, Intertronics Company Website.

* cited by examiner

*Primary Examiner*—David J. Walczak
(74) *Attorney, Agent, or Firm*—Roger A. Jackson

(57) ABSTRACT

A fluid dispenser and method for applying a selected fluid to a desired location includes a reservoir containing the fluid, the reservoir includes a resilient body having a first end and a second end, a first end sealing cap, and a second end sealing cap assembly with a penetrable elastomeric member to define a reservoir interior. The body includes bellows oriented to retract or extend the body between the first end and the second end creating a variable reservoir interior volume. Also included is an applicator having a proximal end and a distal end, the proximal end includes a non coring cannula with a lumen having an insertion end adapted to penetrate through the elastomeric member and protrude into the reservoir interior. This enables fluid communication between the reservoir interior and the lumen; the distal end also includes an application element that is in fluid communication with the lumen.

30 Claims, 8 Drawing Sheets

FLUID DISPENSER

TECHNICAL FIELD

The present invention generally relates to fluid dispensing apparatus and more particularly to a portable manually operated fluid dispenser and applicator for the selective application of a specific fluid to a desired location.

BACKGROUND OF INVENTION

There are a variety of fluid dispensers in the prior art. Fluid dispenser components typically comprise: a reservoir, a means for regulating fluid flow, and an applicator. The reservoir contains a fluid and also has a means for motivating the fluid to communicate into the means for regulating the fluid flow and further communicating to the applicator. The means for motivating the fluid out of the reservoir can be anything from simply using gravity to having a means for increasing the pressure of the fluid in the reservoir thus motivating the fluid to flow out of the reservoir through the means for regulating the fluid flow and onward to the applicator. The means for motivating the fluid out of the reservoir outside of simply using gravity can include using a movable piston inside of a close fitting bore such as in a hypodermic needle, or having a reservoir constructed of a resilient material wherein the reservoir is compressed in some manner to reduce its interior volume thus raising the pressure of the fluid in the reservoir. The means for regulating the fluid flow can include simply having a selectively sized fluid flow passageway, or a valve of some type. The applicator portion of the fluid dispenser can include a pen quill, a hollow needle being a cannula with a lumen, a brush with bristles, or a sponge type material, and the like.

There are many issues surrounding the fluid dispenser, such as accurate controlling of the measured volumes of the fluid dispensed, how to handle the many different types of fluids and their properties, such as viscosity, miscibility of the various fluid components, and the drying or hardening characteristics of the fluid as it flows through the applicator and onto the desired surface, area, or volumemetric cavity at the desired location. Other issues for fluid dispensers would include fluid waste, spillage, leakage, and reuse of the fluid dispenser after a period of inactivity wherein the fluid may dry or harden in or on any of the fluid dispenser components. Typically, once the fluid leaves the sealed reservoir it is exposed to atmospheric air wherein the fluid's volatile compounds start to evaporate and initiate the fluid drying or hardening process which may cause fluid communication problems for the fluid dispenser components being the means to regulate fluid flow and the applicator as the fluid viscosity greatly increases and can essentially cause the fluid dispenser to become inoperative. Also, another issue is the communication of the fluid to the applicator itself, such as with a conventional brush that is dipped into a fluid wherein the fluid is deposited all over the brush which typically causes an excess amount of fluid on the brush requiring at least one brush stroke to remove excess fluid from the brush before use, with typically only one side of the brush which will be applied to the surface and the like. In addition, reservoir breakage and accidental discharge of the fluid can be problems while the fluid dispenser is in use.

In addressing the above-identified issues that are common to fluid dispensers, the prior art discloses a number of different types of apparatus. Starting with the at accurate controlling of the measured volume of fluid to be dispensed, a common solution is to utilize a movable piston in a close fitting bore while closely controlling the axial movement of the piston with graduations marked on the outside of a translucent of clear bore, thus controlling the axial displacement or volume reduction in the reservoir as is common with a hypodermic needle assembly. Another method of controlling the volume of the fluid to be dispensed is to simply size the reservoir volumetrically to contain the desired volume of fluid to be dispensed, which would make the reservoir a single use system that may be disposable if it is not refillable, such as with a common eyedropper assembly. A further method of controlling the volume of fluid to be dispensed is to use a resilient reservoir having an additional apparatus of mechanical stops or a control upon the amount of resilient reservoir volume reduction, such as disclosed in U.S. Pat. No. 5,186,563 to Gebhard et al. and U.S. Pat. No. 4,944,625 to Futter et al. The complexity of the apparatus to control the volume of fluid to be dispensed depends to a large degree upon the volumetric accuracy required, with the piston and bore apparatus being substantially the most accurate, however, having a higher cost to manufacture and also having the attendant disadvantage of requiring a close fitting dynamic fluid seal between the piston and the bore. Also, utilizing a specifically sized volume of reservoir to dispense a selected amount of fluid can result in material waste in the form of making the reservoirs' individually disposable for a single use, or adding additional apparatus to make the reservoir refillable for multiple uses from one reservoir. The use of a resilient reservoir is appealing due to lower cost and simplicity; however, the addition of apparatus to create some sort of mechanical stop or stops can also add complexity and cost to the fluid dispenser assembly.

Further, looking to the fluid dispenser issue of controlling or the regulating the flow of the fluid as it exits the reservoir and communicates to the applicator, the prior art typically utilizes a valve,of some type as is typically disclosed in U.S. Pat. No. 4,470,715 to Reuchlin et al., U.S. Pat. No. 6,056,470 to Nchashi et al., and U.S. Pat. No. 6,402,410 to Hall et al. Alternatively, a fluid flow restriction such as an orifice or the lumen inside of the cannula wherein the fluid dispensed must flow through the orifice or the lumen inside of the cannula is disclosed in U.S. Pat. No. 1,945,957 to Salmon and U.S. Pat. No. 1,935,639 to Keeshan. Obviously, for simplicity the orifice or the lumen would be the most attractive apparatus use for controlling and regulating the flow of fluid, however, the disadvantage of the orifice or the lumen would be the lack of the ability to substantially stop the flow of a fluid when it is desired to prevent spillage or leakage. The use of a valve can accommodate this requirement, however, a valve adds a degree of mechanical complexity that is generally undesirable. The prior art has recognized this problem and has attempted to solve it by making the reservoir and the means for controlling and regulating the flow of fluid as separable pieces, creating the ability to separately clean the means for controlling and regulating the flow of fluid, such as typically disclosed in U.S. Pat. No. 4,447,169 to Vartoughian. Adding the requirement that if the means for controlling and regulating the flow of fluid were removed from the reservoir requires that the reservoir outlet would have to be sealable, which of course again requires a valve or cap to substantially seal reservoir outlet as disclosed in U.S. Pat. No. 3,969,028 to Negreiros, U.S. Pat. No. 3,592,202 to Jones, and U.S. Pat. No. 5,975,088 to Stehman. This causes the attendant problems of when the fluid dries or hardens after exposure to atmospheric air, the valve or the cap will tend to gum up or stick causing difficulty in initiating reuse of the fluid dispenser for having the fluid flow out of the reservoir outlet and into the means for regulating fluid flow, and finally to the applicator.

What is needed is a fluid dispenser that overcomes the previously identified issues related to fluid dispensers, being selectable volumes of fluid to dispense from the reservoir, the means of controlling or regulating the fluid flow, having reduced susceptibility to the fluid drying or hardening from exposure to atmospheric air, the method of applying the fluid to the applicator, and having the reservoir separable from the means of controlling the regulating the fluid flow. While at the same time keeping the objectives of simplicity, function and minimal manufacturing cost paramount. This requires a reservoir that has an easily controllable interior volume adjustment with reduced risk of rupture, breakage, or leakage of the reservoir fluid and with the reservoir having a resealable outlet that minimizes the problems of the fluid drying or hardening that would restrict the fluid communicating from the reservoir outlet that is caused from the fluid being exposed to atmospheric air while the same time reducing the risk of accidental spillage of the fluid from the reservoir. Also, this would require that the means of controlling and regulating the fluid flow would deposit the fluid to an interior portion of the applicator thus minimizing the need for removal of excess fluid from the applicator prior to use.

SUMMARY OF INVENTION

The present invention of a fluid dispenser for manually applying a selected fluid to a desired location includes a reservoir assembly that is able to contain the selected fluid, the reservoir also includes a resilient body portion having a first end and a second end, a first end sealing cap, and a second end sealing cap assembly to define a reservoir interior. The reservoir body has bellows oriented to retract or extend the body between the first end and the second end to create a variable reservoir interior volume, with the second end-sealing cap assembly including a penetrable elastomeric member. In addition, the fluid dispenser includes an applicator that has a proximal end and a distal end, the proximal end includes a non coring cannula with a lumen having an insertion end that is adapted to insert and penetrate through the elastomeric member and protrude into the reservoir interior. This enables fluid communication between the reservoir interior and the lumen; the distal end also includes an application element that is in fluid communication with the lumen.

These and other objects of the present invention will become more readily appreciated and understood from a consideration of the following detailed description of the exemplary embodiments of the present invention when taken together with the accompanying drawings, in which;

REFERENCE NUMBER IN DRAWINGS

Figure 1:
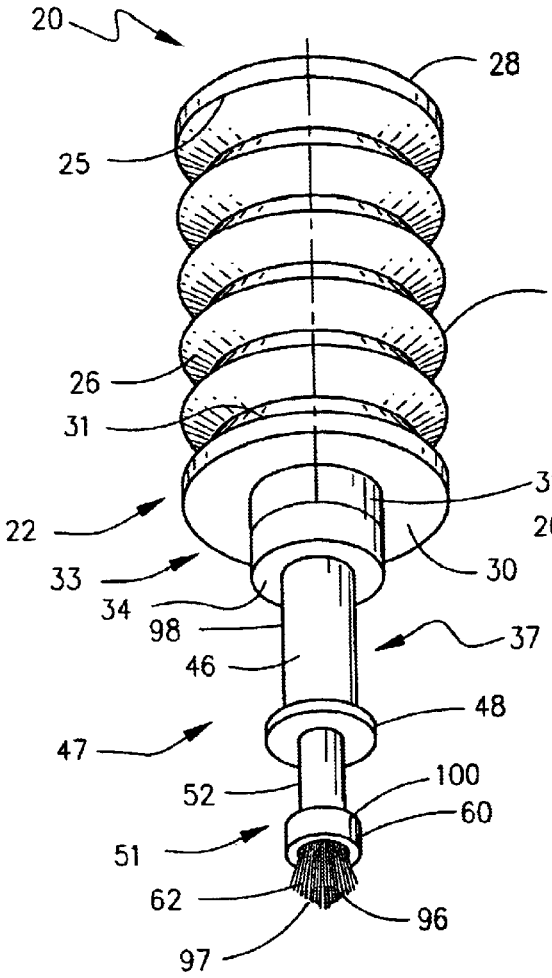
FIG. 1 is a perspective view of the fluid dispenser assembly from the applicator side.

20 Fluid dispenser assembly
21 Refill fluid dispenser assembly
22 Reservoir assembly
24 Resilient body portion
25 Resilient body portion first end
26 Bellows
27 Bellows extended position state
28 First end sealing cap
29 Bellows retracted position state
30 Second end sealing cap
31 Resilient body portion second end
32 Penetrable elastomeric member support
33 Second end sealing cap assembly
34 Penetrable elastomeric member retainer
35 Reservoir interior and variable reservoir interior volume
36 Penetrable elastomeric member
37 Penetrating non-coring cannula adapter assembly
38 Penetrating non-coring cannula body
39 Penetrating non-coring cannula assembly
40 Penetrating non-coring cannula nose tip
41 Penetrating non-coring cannula taper
42 Penetrating non-coring cannula aperture

43 Penetrating non-coring cannula insertion end
44 Penetrating non-coring cannula lumen
45 Longitudinal axis of lumen
46 Penetrating non-coring cannula adapter body
47 Applicator assembly
48 Penetrating non-coring cannula adapter body rim
49 Penetrating non-coring cannula adapter refill assembly
50 Penetrating non-coring cannula adapter aperture
51 Application element assembly
52 Application element cannula body
53 Penetrating non coring cannula adapter for attachment to an external selected fluid source
54 Application element cannula adapter end
56 Application element cannula discharge end
58 Application element cannula lumen
60 Application element retainer
62 Application element
64 Fluid dispenser selected fluid
66 Reservoir assembly for snap bellows
67 Snap bellows reservoir interior and variable reservoir interior volume
68 Snap bellows resilient body portion
69 Snap bellows resilient body portion first end
70 Snap bellows long side
71 Snap bellows resilient body portion second end
72 Snap bellows short side
74 Large snap bellows angle
76 Small snap bellows angle
78 Snap bellows resilient body portion in an extended position state
80 Snap bellows resilient body portion in a retracted position state
82 First resilient arcuate wall portion
84 Second resilient arcuate wall portion
86 Valve closure
88 Applicator support element
90 Application element in the form of a nozzle element
92 Application element in the form of an open cell foam element
94 External selected fluid source
96 Application element in the form of a brush element
97 Brush element bristles
98 Applicator proximal end
100 Applicator distal end
102 Valve
104 Common discharge passage
106 Penetrating non coring cannula body with lumen therethrough
108 Penetrating non coring cannula lumen therethrough
110 Penetrating non coring cannula with lumen therethrough rounded nose ridge
112 Penetrating non coring cannula with lumen therethrough cannula body taper
114 Longitudinal axis of lumen therethrough
116 Penetrating non coring cannula body with lumen therethrough assembly
118 Penetrating non coring cannula body with lumen therethrough insertion end

DETAILED DESCRIPTION

Figure 2:
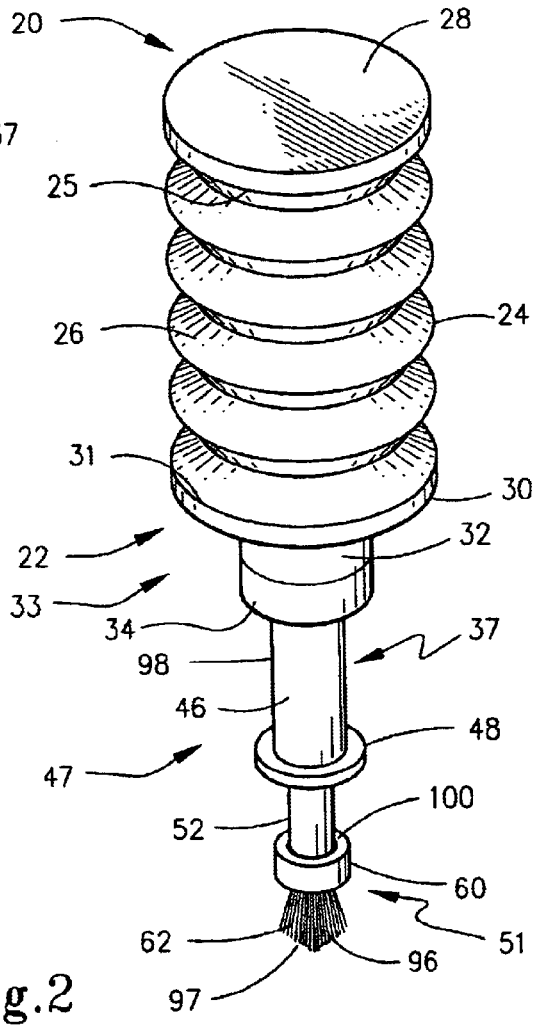
FIG. 2 is a perspective view of the fluid dispenser assembly from the first end sealing cap side.

With initial reference to FIGS. 1 and 2, FIG. 1 shows a perspective view of the fluid dispenser 20 assembly from the applicator 47 side and FIG. 2 shows a perspective view of the fluid dispenser assembly 20 from the first end sealing cap 28 side. The fluid dispenser 20 is designed to allow the user to manually apply a selected fluid to a desired location by the user and comprises two major elements, being a reservoir assembly 22 and the applicator assembly 47. The reservoir assembly 22 that is able to contain the selected fluid includes a resilient body portion 24 that has a resilient body portion first end 25 and a resilient body portion second end 31. The reservoir assembly 22 also includes a first end sealing cap 28 and a second end sealing cap assembly 33 that includes a second end-sealing cap 30 that acts in conjunction with the resilient body portion 24 to define a reservoir interior that is not shown in FIGS. 1 and 2. The resilient body portion 24 has a bellows 26 that is oriented to retract or extend the resilient body portion 24 between the resilient body portion first end 25 and the resilient body portion second end 31 with the result that a variable reservoir interior volume is possible. The second end-sealing cap 30 also includes a penetrable elastomeric member retainer 34, a penetrable elastomeric member support 32, and a penetrable elastomeric member that is not shown in FIGS. 1 and 2. The fluid dispenser assembly 20 also includes the applicator assembly 47 that is comprised of a proximal end 98 and a distal end 100. The proximal end 98 includes a penetrating non-coring cannula adapter assembly 37 that also includes a penetrating non-coring cannula, a penetrating and non-coring cannula adapter body rim 48, and a non-coring cannula with a lumen that is not shown in FIGS. 1 and 2. The distal end 100 includes an application element cannula body 52 and an application element assembly 51. The application element assembly 51 is comprised of an application element retainer 60, an application element 62 that is depicted in FIGS. 1 and 2 as an application element in the form of a brush element 96 with brush element bristles 97.

Figure 3:
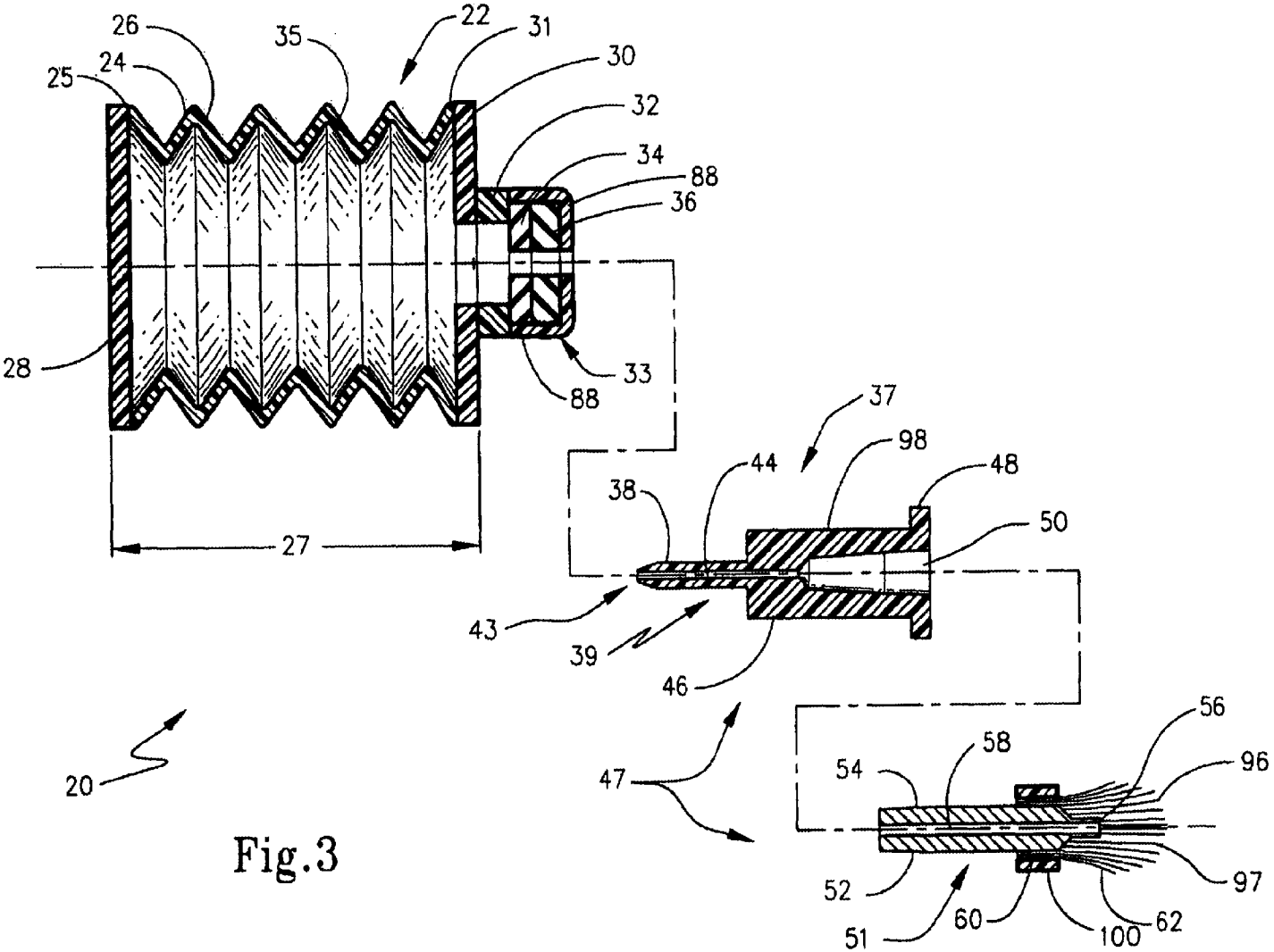
FIG. 3 is an exploded cross sectional view of the fluid dispenser assembly elements being a reservoir and an applicator that includes a non-coring cannula and an application element.
Figure 7:
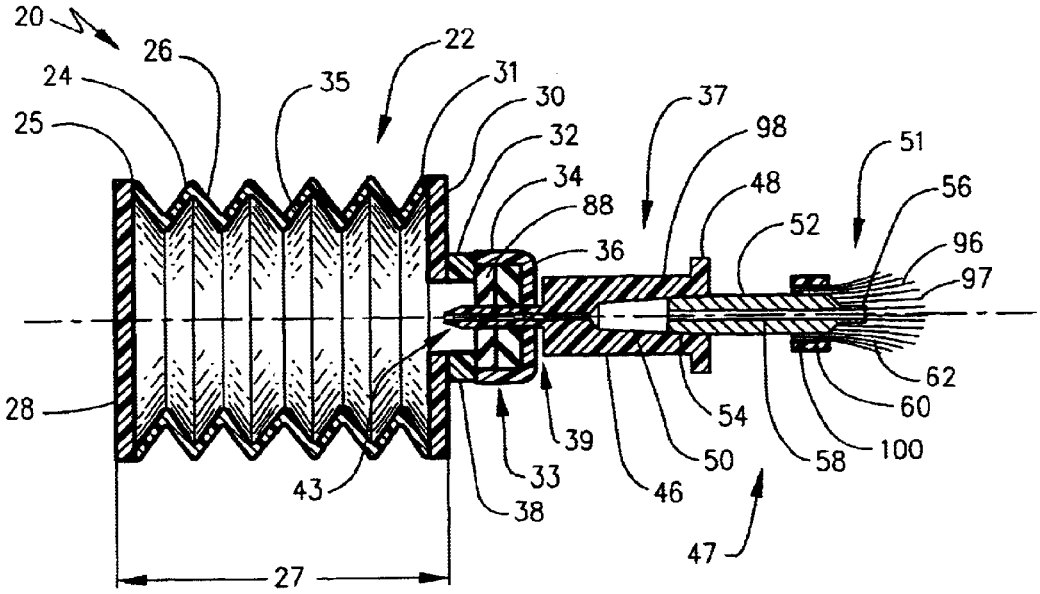
FIG. 7 is a cross section view of the fluid dispenser assembly.

Turning next to FIG. 3 shown is an exploded cross sectional view of the fluid dispenser assembly 20 elements, broadly being the reservoir assembly 22 and an applicator assembly 47 that includes the penetrating non coring cannula adapter assembly 37 and the application element assembly 51. FIG. 7 shows the exploded cross section view of FIG. 3 assembled comprising the fluid dispenser assembly 20. The reservoir assembly 22 that is able to contain the selected fluid includes a resilient body portion 24 that has a resilient body portion first end 25 and a resilient body portion second end 31. The reservoir assembly 22 also includes a first end sealing cap 28 and a second end sealing cap assembly 33 that includes a second end sealing cap 30 that acts in conjunction with the resilient body portion 24 to define a reservoir interior 35. The resilient body portion 24 has a bellows 26 that is oriented to retract or extend the resilient body portion 24 between the resilient body portion first end 25 and the resilience body portion second end 31 with the result that a variable reservoir interior volume 35 is possible. As shown in FIGS. 3 and 7 the bellows 26 is in a bellows extended position state 27. The second end sealing cap 30 also includes a penetrable elastomeric member retainer 34, a penetrable elastomeric member support 32, and a penetrable elastomeric member 36. There is also included an applicator support element 88 that is secured between the reservoir assembly 22 and the applicator assembly 47. The applicator support element 88 is intended to provide additional support to the applicator assembly 47 attachment to the reservoir assembly 22 being secured between the reservoir assembly 22 and the applicator assembly 47, wherein the interface of the penetrating non coring cannula body 38 and the penetrable elastomeric member 36 after the penetrating non coring cannula body 38 has been inserted and penetrated through the penetrable elastomeric member 36 provides an inadequately rigid attachment between the applicator assembly 47 and the reservoir assembly 22. The form of the applicator support element 88 can be either internal or external to the reservoir assembly 22. FIGS. 3 and 7 show the applicator support element 88 to be internally mounted, thus residing in the reservoir interior 35, with the applicator support element 88 having a slidable or removable engagement with the penetrating non coring cannula body 38, thus providing extra support rigidity for the attachment between the reservoir assembly 22 and the applicator assembly 47. However, the applicator support element 88 could just as well be mounted on the exterior of the reservoir assembly 22 being secured between the second end sealing cap assembly 33 and the penetrating non coring cannula adapter assembly 37 of the applicator assembly 47, wherein the applicator support element 88 would be removably engagable on either or both the second end the sealing cap assembly 33 and the penetrating non coring cannula adapter assembly 37 of the applicator assembly 47.

The materials of construction for the resilient body portion 24 are preferably a resilient synthetic plastic, however, the resilience synthetic plastic could be constructed of materials selected from a group consisting essentially of polyethylene, polypropylene, or polyurethane materials all of which would be preferably compatible with the selected fluid. It may also be desirable for the resilient body portion 24 to be constructed of a translucent or clear material to allow the selected fluid that is contained in the reservoir assembly 22 interior volume 35 to be viewed by the user of the fluid dispenser assembly 20, thus allowing the user to ascertain both the quantity of selected fluid in the interior volume 35 and the color of the selected fluid in the interior volume 35. The materials of construction for the first end sealing cap 28, the second end sealing cap 30, penetrable elastomeric member support 32, applicator support element 88, and penetrable elastomeric member retainer 34 can be constructed of any material that is preferably compatible with the selected fluid. The materials of construction for the penetrable elastomeric member 36 should be in addition to being preferably compatible with the selected fluid have a resiliency to allow for a substantially fluid tight seal between the penetrable elastomeric member 36 and a penetrating non coring cannula body 38 when a penetrating non coring cannula body 38 with the penetrating non coring cannula insertion end 43 is inserted and penetrated through the penetrable elastomeric member 36 and protruding into the reservoir interior 35. In addition, the materials of construction for the penetrable elastomeric member 36 should allow for a substantially fluid tight seal when the penetrating non-coring cannula insertion end 43 is removed from the penetrable elastomeric member 36. In total, the materials of construction for the reservoir assembly are also preferably non-breakable thus helping to preclude a user accidentally breaking or rupturing the reservoir assembly 22 thus spilling the selected fluid.

The fluid dispenser assembly 20 also includes the applicator assembly 47 that is comprised of a proximal end 98 and a distal end 100. The proximal end 98 includes a penetrating non-coring cannula adapter assembly 37 that includes a penetrating non-coring cannula assembly 39. The penetrating non-coring cannula assembly 39 comprises a penetrating non-coring cannula body 38 with a penetrating non-coring cannula lumen 44, and a penetrating non-coring cannula insertion end 43. The penetrating non coring cannula insertion end 43 is adapted to insert and penetrate through the penetrable elastomeric member 36 and protrude into the reservoir interior 35 to enable fluid communication between the reservoir interior 35 and the non coring cannula lumen 44. The side of the penetrating non coring cannula body 38 opposite of the penetrating non coring cannula insertion end 43 has a penetrating non coring cannula adapter body 46 that terminates in a penetrating non coring cannula adapter body rim 48 and a penetrating non coring cannula adapter aperture 50 that is in fluid communication with the penetrating non coring cannula lumen 44. The distal end 100 includes an application element cannula body 52 with an application element cannula lumen 58 with the application element cannula body 52 including an application element cannula adapter end 54 and an application element cannula discharge end 56. The application element cannula discharge end 56 includes an application element retainer 60 and an application element 62, which in FIG. 3 is an application element in the form of a brush element 96 with brush element bristles 97. The penetrating non-coring cannula adapter aperture 50 is in fluid communication with the application element cannula lumen 58 that is in fluid communication with the application element 62.

The materials of construction for the penetrating non coring cannula body 38, the penetrating non coring cannula adapter body 46, the penetrating non coring cannula adapter body rim 48, the application element cannula body 52, the application element retainer 60, and application element 62 can be constructed of any material that is preferably compatible with the selected fluid.

Although FIG. 3 shows the applicator assembly 47 in two separable pieces being the penetrating non coring cannula adapter assembly 37 and the application element assembly 51, it is possible that the applicator assembly 47 could be a single piece having a continuous fluid communication from the penetrating non coring cannula lumen 44 to the application element cannula lumen 58. As shown in FIG. 3 with the applicator assembly 47 being in two separable pieces, being the penetrating non coring cannula adapter assembly 37 and the application element assembly 51, the application element cannula adapter end 54 and the penetrating non coring cannula adapter aperture 50 are matingly engagable in a substantially fluid type manner. This is to allow the application element assembly 51 to be interchangeable.

Figure 4:
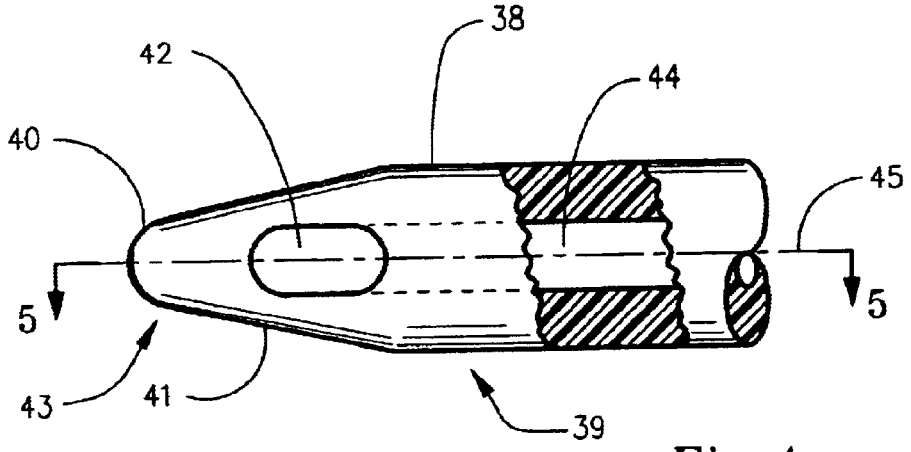
FIG. 4 is a detailed cross section view of the non-coring cannula.
Figure 5:
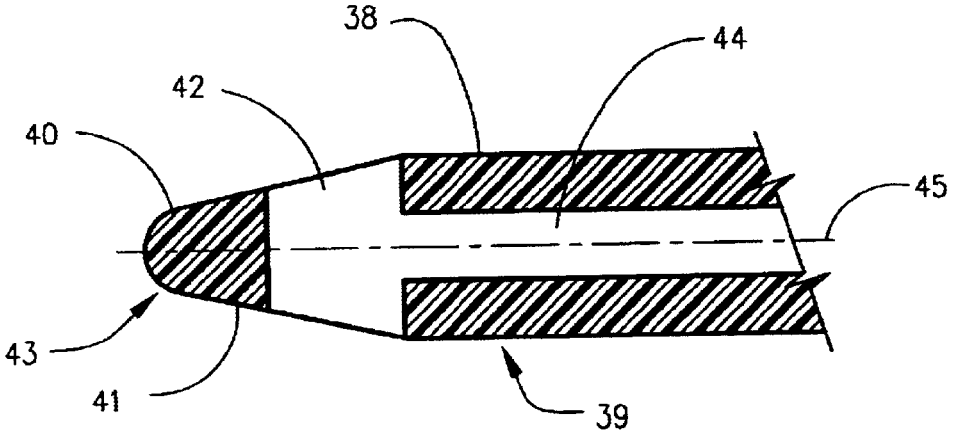
FIG. 5 is a detailed cross section view of the non coring cannula rotated ninety (90) degrees from FIG. 4.
Figure 6:
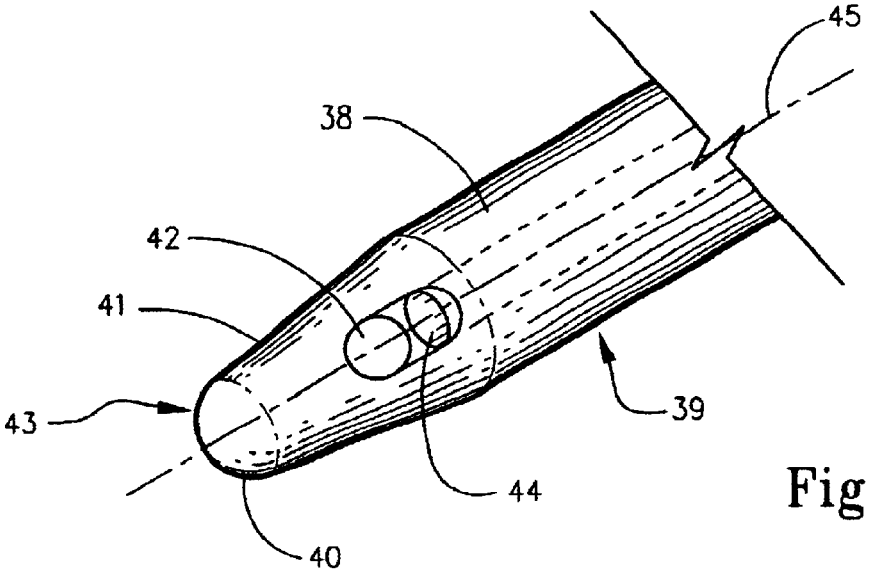
FIG. 6 is a perspective view of the non-coring cannula.

Further, to FIGS. 4, 5, and 6 shown are detailed cross section views and a perspective view of the penetrating non-coring cannula assembly 39, specifically detailing the penetrating non-coring cannula insertion end 43. The penetrating non coring cannula body 38 includes a penetrating non coring cannula lumen 44, a longitudinal axis of the lumen 45, a penetrating non coring cannula aperture 42, a penetrating non coring cannula taper 41, and a penetrating non coring cannula nose tip 40. The penetrating non coring cannula taper 41 goes from the penetrating non coring cannula body 38 to the penetrating non coring cannula nose tip 40. The purpose of the penetrating non coring cannula assembly 39, specifically detailing the penetrating of the non coring cannula insertion end 43 is to prevent cutting and or coring of the penetrable elastomeric member 36 when the penetrating non coring cannula insertion end 43 is inserted and penetrated through the penetrable elastomeric member 36. This prevents removal of material from the penetrable elastomeric member 36 that could interfere with the ability of the penetrable elastomeric member 36 being able to substantially form a fluid tight seal when the penetrating non coring cannula insertion end 43 of the penetrating non coring cannula assembly 39 is removed from the penetrable elastomeric member 36. In addition, if the penetrating non coring cannula insertion end 43 generated debris from cutting and or coring of the penetrable elastomeric member 36 when the penetrating non coring cannula insertion end 43 is inserted and penetrated through the and penetrable elastomeric member 36 there is a risk that these debris could lodge in the penetrating non coring cannula lumen 44 and potentially obstruct flow of the selected fluid in the penetrating non coring cannula lumen 44.

Also, there is an inherent degree of additional safety with the penetrating non coring cannula insertion end 43 having the penetrating non coring cannula nose tip 40 being blunt and not sharp to minimize risk to the user of accidentally pricking a finger and the like. The penetrating non coring cannula aperture 42 is oriented substantially transverse to the longitudinal axis of the lumen 45 with the penetrating non coring cannula aperture 42 and the penetrating non coring cannula lumen 44 being in fluid communication. The penetrating non coring cannula aperture 42 is positioned within the penetrating non coring cannula insertion end 43 or being inboard of the penetrating non coring cannula nose tip 40. This is to create a blunt solid cannula nose tip 40 on the penetrating non coring cannula insertion end 43 with the effect of the penetrating non coring cannula lumen 44 terminating inboard of the penetrating non coring cannula nose tip 40 to prevent cutting and coring of the penetrable elastomeric member 36, while the penetrating non coring cannula insertion end 43 is inserted and penetrated through the penetrable elastomeric member 36.

As the penetrating non coring cannula insertion end 43 has the penetrating non coring cannula nose tip 40 being blunt and not sharp creates the requirement that the penetrable elastomeric member 36 be pre pierced to accommodate the penetrating non coring cannula insertion end 43 and the penetrating non coring cannula nose tip 40 being able to insert and penetrate the penetrable elastomeric member 36 without removal of material from the penetrable elastomeric member 36. The pre piercing of the penetrable elastomeric member 36 is preferably accomplished by producing a slit in the penetrable elastomeric member 36 therethrough, with the size of the slit being slightly larger than the outside diameter of the penetrating non coring cannula body 38 which will allow passage of the penetrating non coring cannula insertion end 43 to allow fluid communication between the reservoir interior 35 and the penetrating non coring cannula aperture 42 while maintaining a substantially fluid tight seal between the penetrable elastomeric member 36 and the outside diameter of the penetrating non coring cannula body 38. Also, with the penetrable elastomeric member 36 maintaining a substantially fluid tight seal at the slit with the penetrating non coring cannula insertion end 43 and penetrating non coring cannula body 38 removed from the penetrable elastomeric member 36. This allows multiple insertions and removals' of the penetrating non coring cannula assembly 39 into and from the penetrable elastomeric member 36 while maintaining either fluid communication from the reservoir interior 35 through the penetrating non coring cannula aperture 42 and into the penetrating non coring cannula lumen 44 or having the reservoir interior 35 reseal at the slit that is within the penetrable elastomeric member 36 respectively with the penetrating non coring cannula assembly 39 is removed from the penetrable elastomeric member 36.

Figure 17:
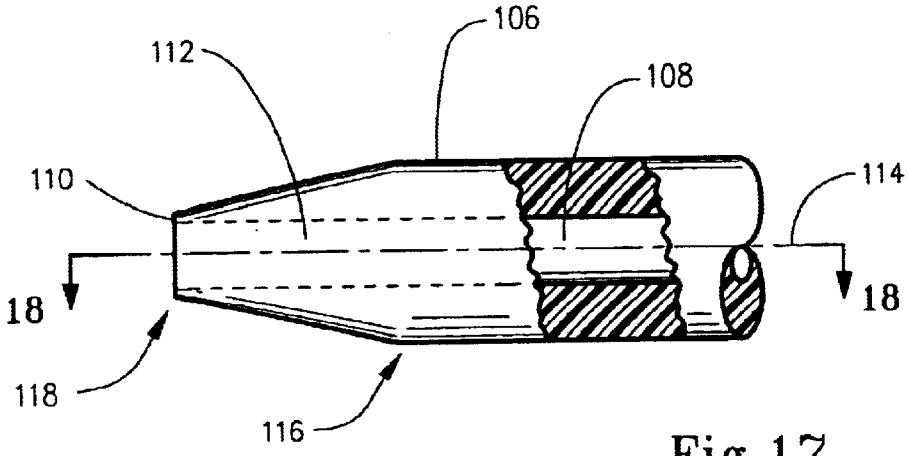
FIG. 17 is a detailed cross section view of the non-coring cannula body with lumen therethrough.
Figure 18:
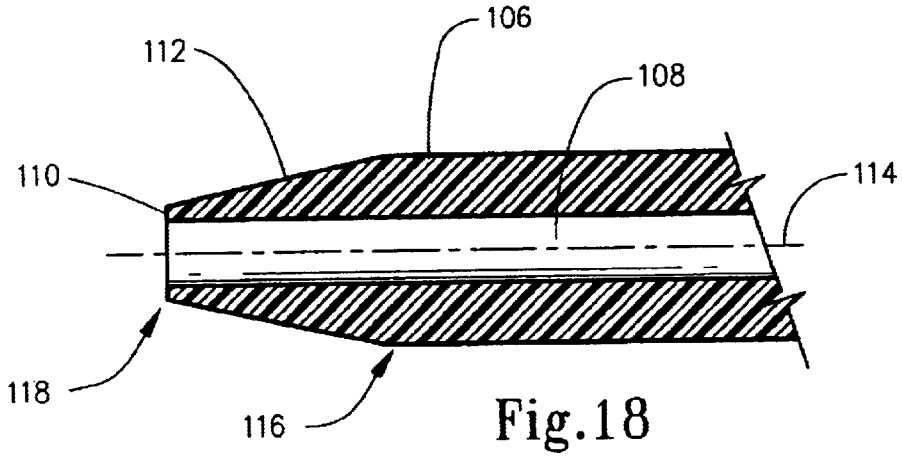
FIG. 18 is a detailed cross section view of the non coring cannula with lumen therethrough rotated ninety (90) degrees from FIG. 17.
Figure 19:
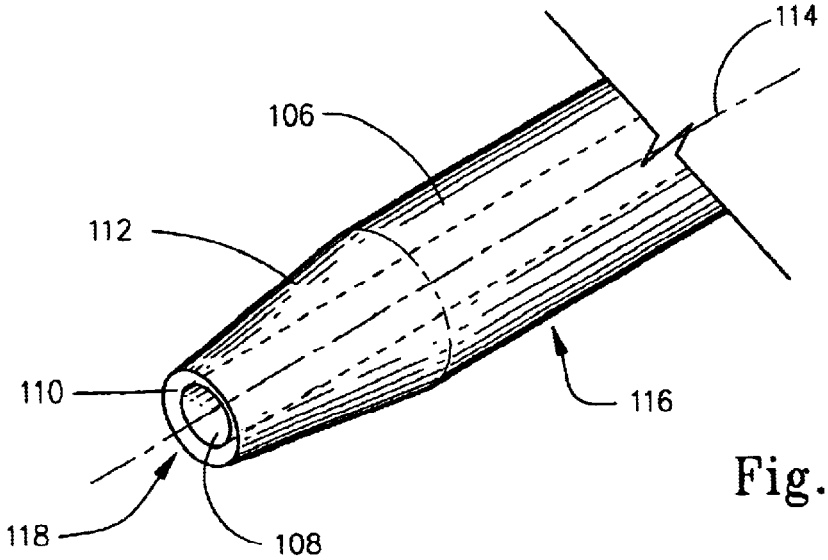
FIG. 19 is a perspective view of the non-coring cannula body with lumen therethrough.

Further, referencing ahead to FIGS. 17, 18, and 19 shown is an alternative cannula with a lumen therethrough for use with the fluid dispenser assembly 20, that is detailed in cross section views and a perspective view of the penetrating non-coring cannula body with lumen therethrough assembly 116, specifically detailing the penetrating non-coring cannula body with lumen therethrough insertion end 118. The penetrating non coring cannula body with lumen therethrough 106 includes a penetrating non coring cannula lumen therethrough 108, a longitudinal axis of the lumen therethrough 114, a penetrating non coring cannula with lumen therethrough body taper 112, and a penetrating non coring cannula with lumen therethrough rounded nose ridge 110. The penetrating non coring cannula with lumen therethrough body taper 112 goes from the penetrating non coring cannula body with lumen therethrough 106 to the penetrating non coring cannula with lumen therethrough rounded nose ridge 110. The purpose of the penetrating non-coring cannula body with lumen therethrough assembly 116, specifically detailing the penetrating of the penetrating non coring cannula with lumen therethrough rounded nose ridge 110 is to prevent cutting and or coring of the penetrable elastomeric member 36 when the penetrating non-coring cannula body with lumen therethrough insertion end 118 is inserted and penetrated through the penetrable elastomeric member 36. This prevents removal of material from the penetrable elastomeric member 36 that could interfere with the ability of the penetrable elastomeric member 36 being able to substantially form a fluid tight seal when the penetrating non-coring cannula body with lumen therethrough insertion end 118 of the penetrating non-coring cannula body with lumen therethrough assembly 116 is removed from the penetrable elastomeric member 36. In addition, if the penetrating non-coring cannula body with lumen therethrough insertion end 118 generated debris from cutting and or coring of the penetrable elastomeric member 36 when the penetrating non-coring cannula body with lumen therethrough insertion end 118 is inserted and penetrated through the and penetrable elastomeric member 36 there is a risk that these debris could lodge in the penetrating non coring cannula lumen therethrough 108 and potentially obstruct flow of the selected fluid in the penetrating non coring cannula lumen therethrough 108.

Also, there is an inherent degree of additional safety with the penetrating non-coring cannula body with lumen therethrough insertion end 118 having the penetrating non coring cannula with lumen therethrough rounded nose ridge 110 being blunt and not sharp to minimize risk to the user of accidentally pricking a finger and the like.

As the penetrating non-coring cannula body with lumen therethrough insertion end 118 has the penetrating non coring cannula with lumen therethrough rounded nose ridge 110 being blunt and not sharp creates the requirement that the penetrable elastomeric member 36 be pre pierced to accommodate the penetrating non-coring cannula body with lumen therethrough insertion end 118 and the penetrating non coring cannula with lumen therethrough rounded nose ridge 110 being able to insert and penetrate the penetrable elastomeric member 36 without removal of material from the penetrable elastomeric member 36. The pre piercing of the penetrable elastomeric member 36 is preferably accomplished by producing a slit in the penetrable elastomeric member 36 therethrough, with the size of the slit being slightly larger than the outside diameter of the penetrating non coring cannula body with lumen therethrough 106 which will allow passage of the penetrating non-coring cannula body with lumen therethrough insertion end 118 to allow fluid communication between the reservoir interior 35 and the penetrating non coring cannula lumen therethrough 108 while maintaining a substantially fluid tight seal between the penetrable elastomeric member 36 and the penetrating non coring cannula body with lumen therethrough 106. Also, with the penetrable elastomeric member 36 maintaining a substantially fluid tight seal at the slit with the penetrating non-coring cannula body with lumen therethrough insertion end 118 and penetrating non coring cannula body with lumen therethrough 106 removed from the penetrable elastomeric member 36. This allows multiple insertions and removals' of the penetrating non-coring cannula body with lumen therethrough assembly 116 into and from the penetrable elastomeric member 36 while maintaining either fluid communication from the reservoir interior 35 through the penetrating non coring cannula lumen therethrough 108 or having the reservoir interior 35 reseal at the slit that is within the penetrable elastomeric member 36 respectively with the penetrating non-coring cannula body with lumen therethrough assembly 116 is removed from the penetrable elastomeric member 36.

Figure 8:
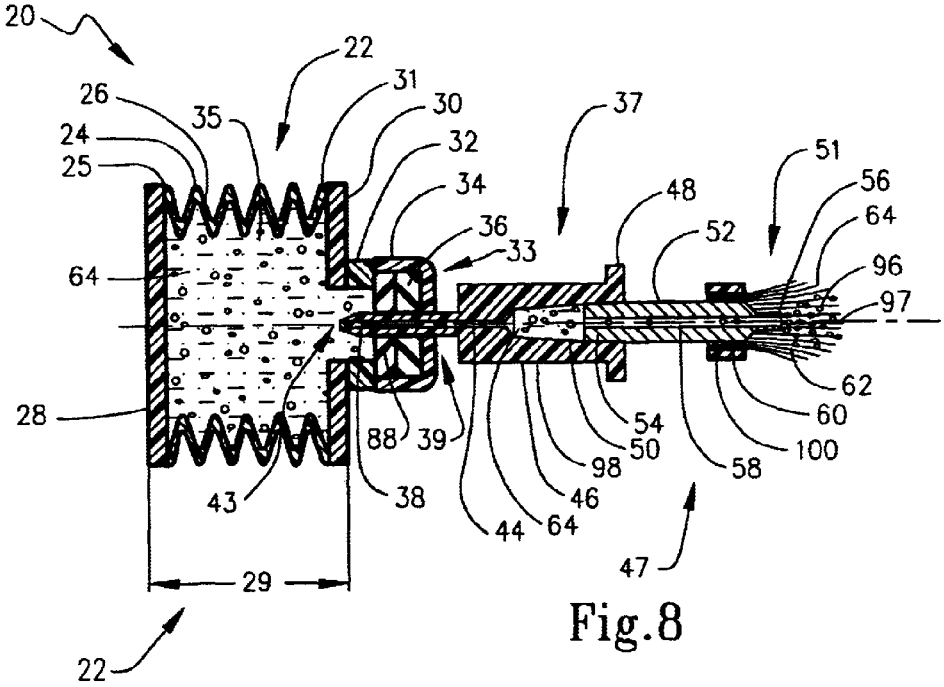
FIG. 8 is a cross section view of the fluid dispenser assembly in use with a selected fluid communicating from the reservoir to the applicator that includes an application element in the form of a brush element.

Next, further to FIG. 8 shown is a cross section view of the fluid dispenser assembly 20 in use with a selected fluid 64 communicating from the reservoir assembly 22 to the applicator assembly 47 that includes an application element assembly 51 with the application element in the form of a brush element 96. The reservoir assembly 22 that is able to contain the selected fluid 64 includes a resilient body portion 24 that has a resilient body portion first end 25 and a resilient body portion second end 31. The reservoir assembly 22 also includes a first end sealing cap 28 and a second end sealing cap assembly 33 that includes a second end sealing cap 30 that acts in conjunction with the resilient body portion 24 to define a reservoir interior 35. The resilient body portion 24 has a bellows 26 that is oriented to retract or extend the resilient body portion 24 between the resilient body portion first end 25 and the resilience body portion second end 31 with the result that a variable reservoir interior volume 35 is possible. The bellows 26 is in a bellows retracted position state 29. The second end sealing cap 30 also includes a penetrable elastomeric member retainer 34, a penetrable elastomeric member support 32, and a penetrable elastomeric member 36.

There is also included an applicator support element 88 that is secured between the reservoir assembly 22 and the applicator assembly 47. The applicator support element 88 is intended to provide additional support to the applicator assembly 47 attachment to the reservoir assembly 22 being secured between the reservoir assembly 22 and the applicator assembly 47. Wherein the interface of the penetrating non coring cannula body 38 and the penetrable elastomeric member 36 after the penetrating non coring cannula body 38 has been inserted and penetrated through the penetrable elastomeric member 36 provides an inadequately rigid attachment between the applicator assembly 47 and the reservoir assembly 22. The form of the applicator support element 88 can be either internal or external to the reservoir assembly 22. FIG. 8 shows the applicator support element 88 to be internally mounted, thus residing in the reservoir interior 35, with the applicator support element 88 having a slidable or removable engagement with the penetrating non coring cannula body 38, thus providing extra support rigidity for the attachment between the reservoir assembly 22 and the applicator assembly 47. However, the applicator support element 88 could just as well be mounted on the exterior of the reservoir assembly 22 being secured between the second end sealing cap assembly 33 and the penetrating non coring cannula adapter assembly 37 of the applicator assembly 47, wherein the applicator support element 88 would be removably engagable on either or both the second end the sealing cap assembly 33 and the penetrating non coring cannula adapter assembly 37 of the applicator assembly 47.

The materials of construction for the resilient body portion 24 are preferably a resilient synthetic plastic, however, the resilient synthetic plastic could be constructed of materials selected from a group consisting essentially of polyethylene, polypropylene, or polyurethane materials all of which would be preferably compatible with the selected fluid 64. It may also be desirable for the resilient body portion 24 to be constructed of a translucent or clear material to allow the selected fluid 64 that is contained in the reservoir assembly 22 interior volume 35 to be viewed by the user of the fluid dispenser assembly 20, thus allowing the user to ascertain both the quantity of selected fluid in the interior volume 35 and the color of the selected fluid in the interior volume 35. The materials of construction for the first end sealing cap 28, the second end sealing cap 30, penetrable elastomeric member support 32, applicator support element 88, and penetrable elastomeric member retainer 34 can be constructed of any material that is preferably compatible with the selected fluid 64. The materials of construction for the penetrable elastomeric member 36 should be in addition to being preferably compatible with the selected fluid 64 have a resiliency to allow for a substantially fluid tight seal between the penetrable elastomeric member 36 and the penetrating non coring cannula body 38 when the penetrating non coring cannula body 38 penetrating non coring cannula insertion end 43 is inserted and penetrated through the penetrable elastomeric member 36 and protrudes into the reservoir interior 35. In addition, the materials of construction for the penetrable elastomeric member 36 should allow for a substantially fluid tight seal when the penetrating non-coring cannula insertion end 43 is removed from the penetrable elastomeric member 36.

In use, the reservoir assembly 22 may be supplied to the user without the selected fluid 64, in other words the reservoir interior 35 would be emptied being devoid of the selected fluid 64. Alternatively, the reservoir assembly 22 may have the reservoir interior volume 35 sized to the pre filled with the selected fluid 64 allowing the user to insert the applicator assembly 47 into the penetrable elastomeric member 36 and subsequently having multiple uses of the fluid dispenser 20, which may be with a single insertion of the applicator assembly 47 into the penetrable elastomeric member 36 or with multiple insertions and removals' of the applicator assembly 47 into and out of the penetrable elastomeric member 36, that would allow cleaning or changing of the applicator assembly 47. This helps to keep the selected fluid 64 from drying out or hardening in the reservoir assembly 22, and also helps in preventing spills and leakage of the selected fluid 64 from the reservoir assembly 22. Also, the reservoir assembly 22 may have the reservoir interior volume 35 sized to be prefilled with a specific volume of the selected fluid 64 allowing the user to insert the applicator assembly 47 into the penetrable elastomeric member 36 and subsequently having a single use of the fluid dispenser 20. The fluid dispenser assembly 20 may be set up for multiple uses with a cleanable applicator assembly 47 or multiple applicator assemblies 47, or may be set up for and single use with either the applicator assembly 47 being disposable, the reservoir assembly 22 being disposable or both the applicator assembly 47 and the reservoir assembly 22 being disposable.

The fluid dispenser assembly 20 also includes the applicator assembly 47 that is comprised of a proximal end 98 and a distal end 100. The proximal end 98 includes a penetrating non-coring cannula adapter assembly 37 that includes a penetrating non-coring cannula assembly 39. The penetrating non-coring cannula assembly 39 comprises a penetrating non-coring cannula body 38 with a penetrating non-coring cannula lumen 44, and a penetrating non-coring cannula insertion end 43. The penetrating non coring cannula insertion end 43 is adapted to insert and penetrate through the penetrable elastomeric member 36 and protrude into the reservoir interior 35 to enable fluid communication between the reservoir interior 35 and the non coring cannula lumen 44. The flowrate of the selected fluid 64 may be controlled by the non coring cannula lumen 44 that can be sized by a flow restriction through either controlling the inside diameter of the non coring cannula lumen 44 or by the use of an orifice restriction positioned adjacent to and in fluid communication with the non coring cannula lumen 44 using generally known flow restriction and orifice fluid flow calculations depending upon the selected fluid 64 properties such as density, viscosity, and the like. The side of the penetrating non coring cannula body 38 opposite of the penetrating non coring cannula insertion end 43 has a penetrating non coring cannula adapter body 46 that terminates in a penetrating non coring cannula adapter body rim 48 and a penetrating non coring cannula adapter aperture 50 that is in fluid communication with the penetrating non coring cannula lumen 44. The distal end 100 includes an application element cannula body 52 with an application element cannula lumen 58 with the application element cannula body 52 including an application element cannula adapter end 54 and an application element cannula discharge end 56. The application element cannula discharge end 56 includes an application element retainer 60 and an application element 62 which in FIG. 8 is an application element in the form of a brush element 96 with brush element bristles 97. The penetrating non-coring cannula adapter aperture 50 is in fluid communication with the application element cannula lumen 58 that is in fluid communication with the application element 62.

The materials of construction for the penetrating non coring cannula body 38, the penetrating non coring cannula adapter body 46, the penetrating non coring cannula adapter body rim 48, the application element cannula body 52, the application element retainer 60, and application element 62 can be constructed of any material that is preferably compatible with the selected fluid 64.

Although FIG. 8 shows the applicator assembly 47 in two separable matingly engagable pieces being the penetrating non coring cannula adapter assembly 37 and the application element assembly 51, it is possible that the applicator assembly 47 could be a single piece having a continuous fluid communication from the penetrating non coring cannula lumen 44 to the application element cannula lumen 58. As shown in FIG. 8 with the applicator assembly 47 being in two separable pieces being the penetrating non coring cannula adapter assembly 37 and the application element assembly 51, the application element cannula adapter end 54 and the penetrating non coring cannula adapter aperture 50 are matingly engagable in a substantially fluid type manner. This is to allow the application element assembly 51 to be interchangeable.

The selected fluid 64 that is used in the fluid dispenser assembly 20 comprises a wide range of different selected fluids 64 wide range of applications as desired by the user. The range of selected fluids can have a wide range in fluid properties, such as density, viscosity, and the like ranging from gases to light liquids, such as water, to heavy gels. Some common examples for the selected fluid 64 would be but not limited to epoxies, glue, various chemical applications, solvents, cosmetically related applications such as lip lacquer, rouge, face makeup, nail polish, nail polish remover, cuticle remover, hair coloring, and shave cream. Other general use fluids for the selected fluid 64 which include ink, paint, stain, correction fluid, shoe polish, foods, sauces, pastry, or medical uses such as, medications, drugs and the like. The desired location of where to apply the selected fluid 64 by the user can include but is not limited to various surfaces, cavities, remote areas, volumes, and the like.

Figure 14:
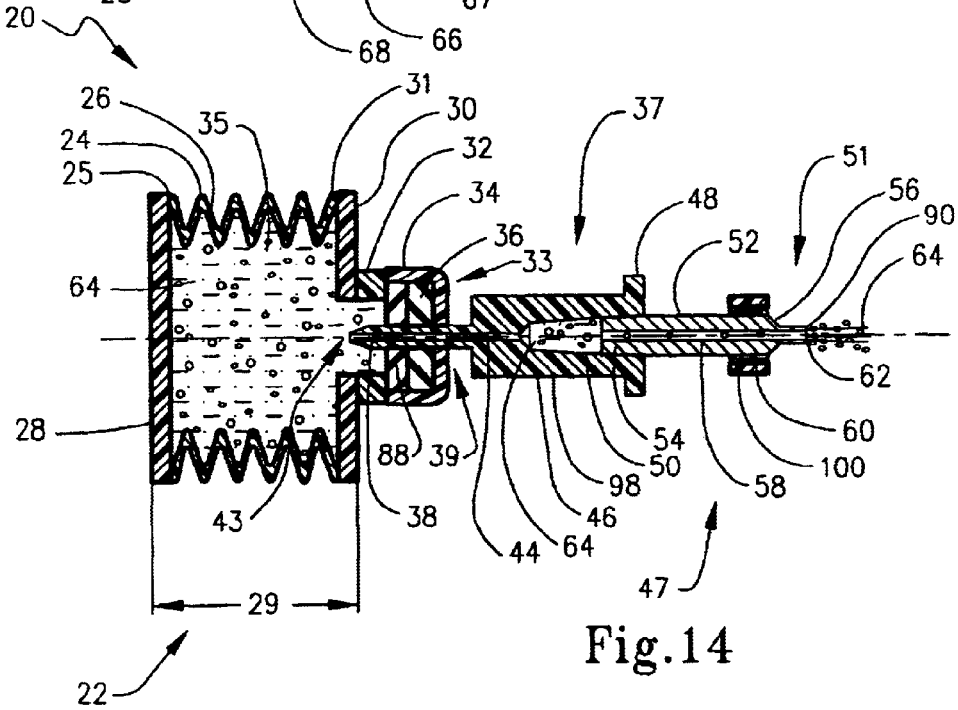
FIG. 14 is a cross section view of the fluid dispenser assembly in use with a selected fluid communicating from the reservoir to the applicator having the application element in the form of a nozzle element.
Figure 15:
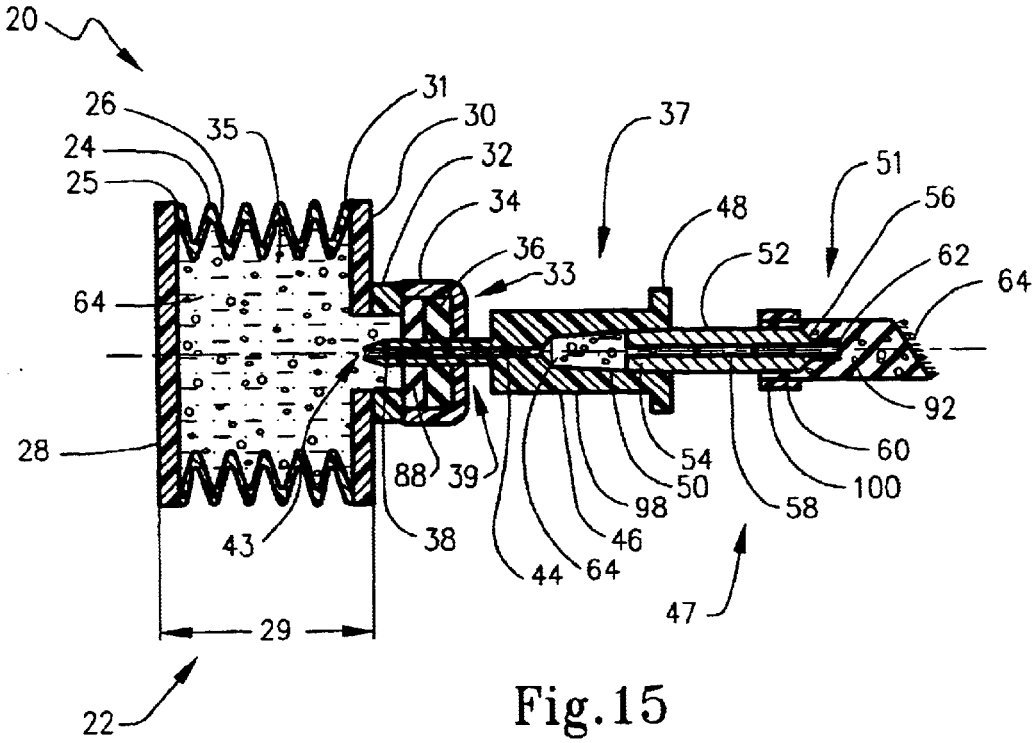
FIG. 15 is a cross section view of the fluid dispenser assembly in use with a selected fluid communicating from the reservoir to the applicator having the application element in the form of an open cell foam element.

Due to the wide range of selected fluids 64 that can be used it is desirable to have a number of options available for the application element 62 to accommodate not only a number of selected fluids 64 but also the variability in the desired locations of where to apply the selected fluid 64. Thus, in referring to FIG. 14 shown is an application element in the form of a nozzle element 90 that would be useful for applying for instance a glue or epoxy to a cavity. Additionally, in referring to FIG. 15 shown is an application element in the form of an open cell foam element 92 that would be useful for applying for instance a paint to a small surface area.

Figure 9:
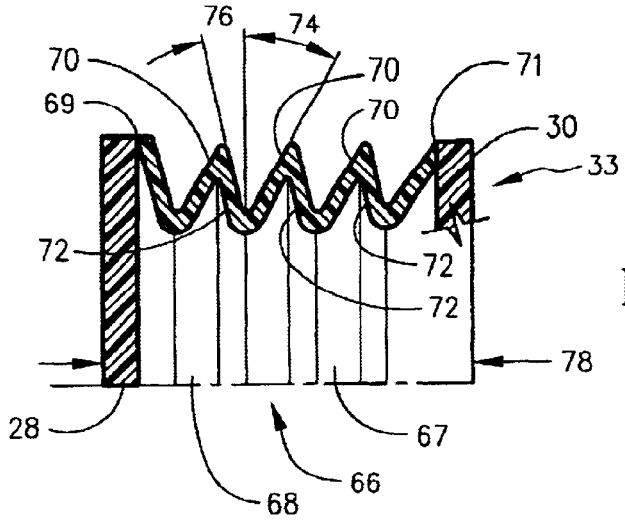
FIG. 9 is a cross sectional view of a snap bellows reservoir assembly in an extended position state.
Figure 10:
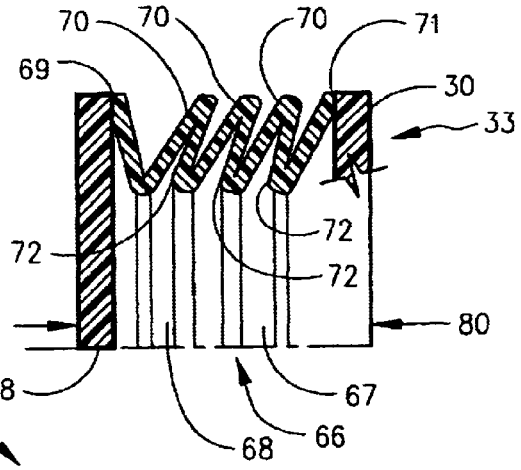
FIG. 10 is a cross sectional view of the snap bellows reservoir assembly in a retracted position state.

Moving to FIGS. 9 and 10 shown is a cross sectional view of a reservoir assembly for snap bellows 66 that shows the snap bellows resilient body portion in an extended position state 78 in FIG. 9 and the reservoir assembly for snap bellows 66 that shows the snap bellows resilient body portion in a retracted position state 80 in FIG. 10. The reservoir assembly for snap bellows 66 shown in FIGS. 9 and 10 is similar to the previously described reservoir assembly 22, wherein a snap bellows resilient body portion 68 replaces the resilient body portion 24 as described in FIG. 3 in the fluid dispenser assembly 20. The reservoir assembly for snap bellows 66 that is able to contain the selected fluid includes a snap bellows resilient body portion 68 having a snap billows resilient body portion first end 69 and a snap bellows resilient body portion second end 71. Also included is the first end-sealing cap 28 and the second end sealing cap assembly 33 of which the second end-sealing cap 30 is shown. The snap bellows resilient body portion 68, the first end sealing cap 28, and the second end sealing cap assembly 33 all act in conjunction to define a snap bellows reservoir interior 67. The snap bellows resilient body portion 68 has bellows that are defined by a plurality of angular segments each having a pair of sides that are of unequal length with a longer side being the snap bellows long side 70 and a shorter side being the snap those bellows short side 72 as shown in the extended position state 78 in FIG. 9. The plurality of angular segments each having a pair of sides that are of unequal length is further defined by the angular differences that reside within a single pair of angular segments, as shown in FIG. 9 by a large snap bellows angle 74 being adjacent to the snap bellows long side 70 and a small snap bellows angle 76 being adjacent to the snap bellows short side 72. The bellows of the snap bellows resilient body portion 68 are oriented to retract in such a manner that the snap bellows short side 72 of each pair is folded back under the snap bellows long side 70 as shown in FIG. 10, with this resulting in the snap bellows resilient body portion 68 retracting between the snap bellows resilient body portion first end 69 and the snap bellows resilient body portion second end 71.

What this results in is that the snap bellows resilient body portion 68 maintains its last selected retracted or extended position, which in turn creates a selectable snap bellows reservoir interior volume 67. Each one of the angular segments comprising the snap bellows long side 70 and the snap bellows short side 72 is deformed slightly as the snap bellows short side 72 is forced under the snap bellows long side 70 and as the snap bellows short side 72 passes center, it is substantially firmly held in place. The retracted position state 80 of the snap bellows resilient body portion 68 as shown in FIG. 10 will maintain the retracted position state 80 until the snap bellows resilient body portion 68 is manually forced into an extended position state 78 as shown in FIG. 9 which will also be maintained until the snap bellows resilient body portion 68 is manually forced into the retracted position state 80. The ability of the reservoir assembly for snap bellows 66 to maintain the extended or retracted position state can have several benefits, such as a volumetrically metered control of the volume of the selected fluid 64 that is either dispensed or filled into the snap bellows reservoir interior 67.

Additionally, when the reservoir assembly for snap bellows 66 is normally used by the user placing the reservoir assembly for snap bellows 66 into the retracted position state, because the snap bellows resilient body portion 68 maintains the retracted position state thus maintaining a reduced snap bellows reservoir interior 67 interior volume, reduces the need for venting of the snap bellows reservoir interior 67 interior volume to facilitate the selected fluid 64 to flow to the application element 62. In addition, the maintaining of the retracted position state for the reservoir assembly for snap bellows 66 reduces the tendency of the reservoir assembly for snap bellows 66 to return to the extended position state thus acting to help prevent the draw of excessive atmospheric air into the snap bellows reservoir interior 67 which can cause the selected fluid 64 to prematurely dry out or to entrain atmospheric air bubbles in the selected fluid 64 causing difficulties in applying the selected fluid 64 from the fluid dispenser assembly 20 through the application element 62 to the desired location by the user.

The materials of construction for the snap bellows resilient body portion 68 are preferably a resilient synthetic plastic, however, the resilient synthetic plastic could be constructed of materials selected from a group consisting essentially of polyethylene, polypropylene, or polyurethane materials all of which would be preferably compatible with the selected fluid. It may also be desirable for the snap bellows resilient body portion 68 to be constructed of a translucent or clear material to allow the selected fluid that is contained in the snap bellows reservoir assembly 66 interior volume 67 to be viewed by the user of the fluid dispenser assembly 20, thus allowing the user to ascertain both the quantity of selected fluid in the interior volume 67 and the color of the selected fluid in the interior volume 67.

Figure 11:
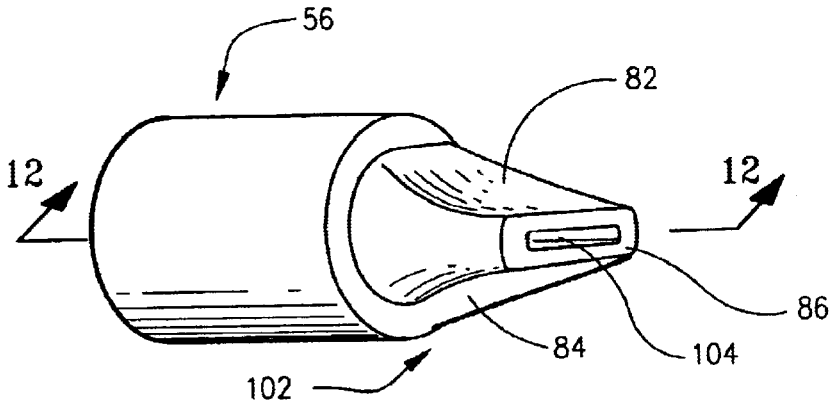
FIG. 11 is a perspective view of the applicator distal end cannula with a valve means shown in a normally urged to close state.
Figure 12:
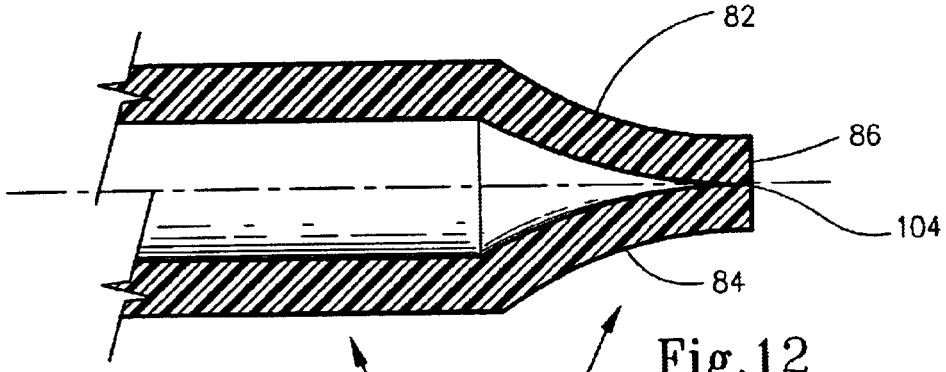
FIG. 12 is a cross section view of the applicator distal end cannula with a valve means shown in the normally urged to close state.
Figure 13:
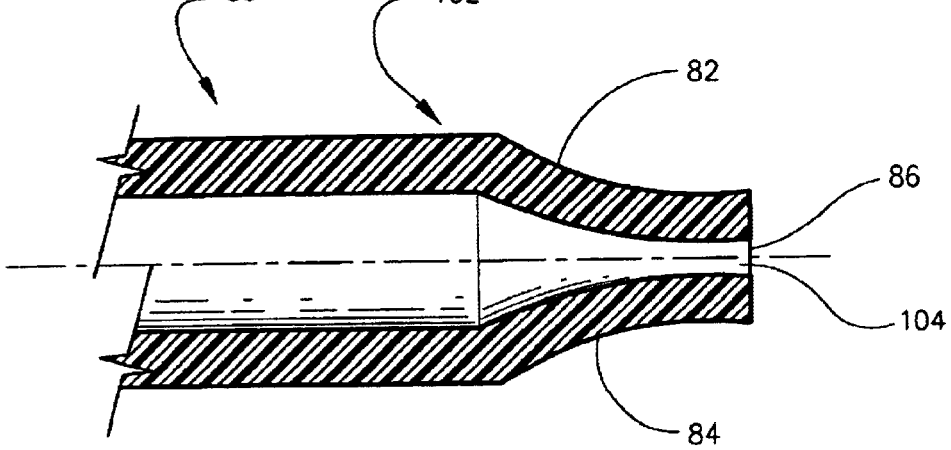
FIG. 13 is a cross section view of the applicator distal end cannula with a valve means shown in a yielded to open state.

Further moving to FIGS. 11, 12, and 13 shown is a perspective view of application element cannula discharge end 56 with a valve 102 shown in a normally urged to close state in FIG. 11, with FIG. 12 showing the valve 102 in a cross section view in the normally urged to close state, and FIG. 13 showing the valve 102 in a cross section view in a yielded to open state. The valve 102 is positioned to be in fluid communication between the penetrating non-coring cannula lumen 44 and the application element 62, being adjacent to the application element cannula discharge end 56. The valve 102 is normally urged to a closed state as shown in FIGS. 111 and 12, and is subsequently yieldable to an open state as shown in FIG. 13 when the valve 102 is exposed to the selected fluid flow from the penetrating non coring cannula lumen 44, this results in the selected fluid in the penetrating non coring cannula lumen 44 then flowing to the application element 62 when the valve 102 is in the open state as shown in FIG. 13.

When the selected fluid ceases or terminates flow from the penetrating non coring cannula lumen 44 to the valve 102, the valve 102 is urged to return to the closed state as shown in FIGS. 11 and 12 with the result that seepage or leakage of the selected fluid from the penetrating non coring cannula lumen 44 onto the application element 62 is substantially reduced. The valve 102 is constructed of a first resilient arcuate wall portion 82 and a second resilient arcuate wall portion 84 that are positioned to be diametrically opposed to one another to define a common discharge passage 104 that terminates in a valve closure 86 therebetween for the selected fluid. The first resilient arcuate wall portion 82 and the second resilient arcuate wall portion 84 are normally urged in a radial inward direction against one another to close the valve 102, thus placing the valve 102 in a closed state as shown in FIGS. 11 and 12. When the valve 102 is exposed to the selected fluid flow from the penetrating non coring cannula lumen 44 the first resilient arcuate wall portion 82 and the second resilient arcuate wall portion 84 are normally urged in a radial outward direction to separate thus to define a common discharge passage 104, and placing the valve 102 in an open state as shown in FIG. 13 allowing the selected fluid to flow from the penetrating non coring cannula lumen 44 to the application element 62.

The materials of construction for the valve 102 are preferably comprised of a silicone rubber or other rubber or rubber like material that has a varying resilience depending upon the viscosity of the selected fluid and is also preferably compatible with the selected fluid.

Figure 16:
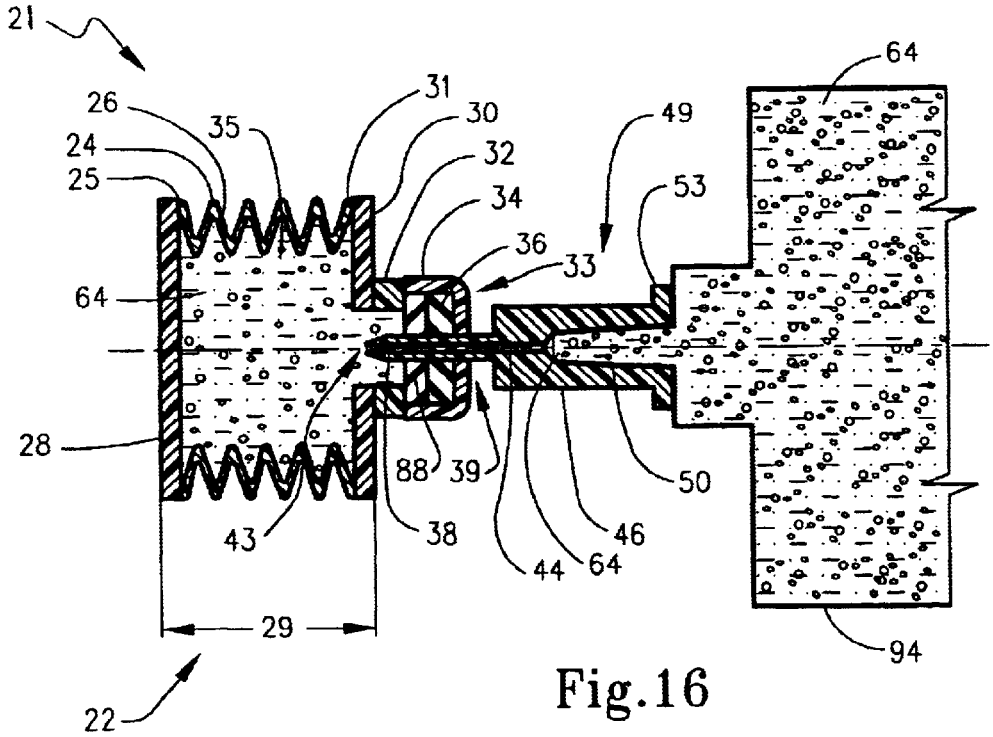
FIG. 16 is a cross section view of the fluid dispenser assembly in use to fill the reservoir from an external selected fluid source with the selected fluid communicating from the external selected fluid source to the reservoir.

Next in looking at FIG. 16, shown is a cross section view of the refill fluid dispenser assembly 21 in use to fill the reservoir assembly 22 from an external selected fluid source 94 with the selected fluid 64 communicating from the external selected fluid source 94 to the reservoir assembly 22. The reservoir assembly 22 that is able to contain the selected fluid 64 includes a resilient body portion 24 that has a resilient body portion first end 25 and a resilient body portion second end 31. The reservoir assembly 22 also includes a first end sealing cap 28 and a second end sealing cap assembly 33 that includes a second end sealing cap 30 that acts in conjunction with the resilient body portion 24 to define a reservoir interior 35. The resilient body portion 24 has a bellows 26 that is oriented to retract or extend the resilient body portion 24 between the resilient body portion first end 25 and the resilience body portion second end 31 with the result that a variable reservoir interior volume 35 is possible. The bellows 26 is in a bellows retracted position state 29. The second end sealing cap 30 also includes a penetrable elastomeric member retainer 34, a penetrable elastomeric member support 32, and a penetrable elastomeric member 36.

There is also included an applicator support element 88 that is secured between the reservoir assembly 22 and the penetrating non coring cannula adapter refill assembly 49 that is adapted to removably engage either or both the reservoir assembly 22 and the penetrating non coring cannula adapter refill assembly 49. The applicator support element 88 is intended to provide additional support to the penetrating non coring cannula adapter refill assembly 49 attachment to the reservoir assembly 22 being secured between the reservoir assembly 22 and the penetrating non coring cannula adapter refill assembly 49, wherein the interface of the penetrating non coring cannula body 38 and the penetrable elastomeric member 36 after the penetrating non coring cannula body 38 has been inserted and penetrated through the penetrable elastomeric member 36 provides an inadequately rigid attachment between the penetrating non coring cannula adapter refill assembly 49 and the reservoir assembly 22. The form of the applicator support element 88 can be either internal or external to the reservoir assembly 22. FIG. 16 shows the applicator support element 88 to be internally mounted, thus residing in the reservoir interior 35, with the applicator support element 88 having a slidable or removable engagement with the penetrating non coring cannula body 38, thus providing extra support rigidity for the attachment between the reservoir assembly 22 and the penetrating non coring cannula adapter refill assembly 49. However, the applicator support element 88 could just as well be mounted on the exterior of the reservoir assembly 22 being secured between the second end sealing cap assembly 33 and the penetrating non coring cannula adapter refill assembly 49. Wherein more particularly the applicator support element 88 would be removably engagable on either or both the second end the sealing cap assembly 33 and the penetrating non coring cannula adapter refill assembly 49.

The materials of construction for the resilient body portion 24 are preferably a resilient synthetic plastic, however, the resilient synthetic plastic could be constructed of materials selected from a group consisting essentially of polyethylene, polypropylene, or polyurethane materials all of which would be preferably compatible with the selected fluid 64. It may also be desirable for the resilient body portion 24 to be constructed of a translucent or clear material to allow the selected fluid 64 that is contained in the reservoir assembly 22 interior volume 35 to be viewed by the user of the refill fluid dispenser assembly 21, thus allowing the user to ascertain both the quantity of selected fluid in the interior volume 35 and the color of the selected fluid in the interior volume 35. The materials of construction for the first end sealing cap 28, the second end sealing cap 30, penetrable elastomeric member support 32, applicator support element 88, and penetrable elastomeric member retainer 34 can be constructed of any material that is preferably compatible with the selected fluid 64. The materials of construction for the penetrable elastomeric member 36 should be in addition to being preferably compatible with the selected fluid 64 have a resiliency to allow for a substantially fluid tight seal between the penetrable elastomeric member 36 and the penetrating non coring cannula body 38 when the penetrating non coring cannula body 38 penetrating non coring cannula insertion end 43 is inserted and penetrated through the penetrable elastomeric member 36 and protrudes into the reservoir interior 35. In addition, the materials of construction for the penetrable elastomeric member 36 should allow for a substantially fluid tight seal when the penetrating non-coring cannula insertion end 43 is removed from the penetrable elastomeric member 36.

The refill fluid dispenser assembly 21 also includes the penetrating non coring cannula adapter refill assembly 49 that is comprised of a penetrating non coring cannula insertion end 43 and an oppositely positioned penetrating non coring cannula adapter 53 for attachment to an external selected fluid source 94. The penetrating non-coring cannula adapter refill assembly 49 includes a penetrating non-coring cannula assembly 39. The penetrating non-coring cannula assembly 39 comprises a penetrating non-coring cannula body 38 with a penetrating non-coring cannula lumen 44, and a penetrating non-coring cannula insertion end 43. The penetrating non coring cannula insertion end 43 is adapted to insert and penetrate through the penetrable elastomeric member 36 and protrude into the reservoir interior 35 to enable fluid communication between the reservoir interior 35 and the non coring cannula lumen 44. The flowrate of the selected fluid 64 may be controlled by the non coring cannula lumen 44 that can be sized by a flow restriction through either controlling the inside diameter of the non coring cannula lumen 44 or by the use of an orifice restriction positioned adjacent to and in fluid communication with the non coring cannula lumen 44 using generally known flow restriction and orifice fluid flow calculations depending upon the selected fluid 64 properties such as density, viscosity, and the like. The side of the penetrating non coring cannula body 38 opposite of the penetrating non coring cannula insertion end 43 has a penetrating non coring cannula adapter body 46 that terminates in a penetrating non coring cannula adapter 53. The penetrating non-coring cannula adapter 53 is adapted for attachment to the external selected fluid source 94. The penetrating non-coring cannula adapter 53 has a substantially fluid tight matingly engagable attachment to the external selected fluid source 94. The external selected fluid source 94 can be any type of external reservoir for containing the selected fluid that will usually be of a higher volumetric selected fluid 64 capacity that the reservoir assembly 22. A penetrating non coring cannula adapter aperture 50 is in fluid communication with the penetrating non coring cannula lumen 44, additionally the penetrating non coring cannula adapter aperture 50 is in fluid communication with the external selected fluid source 94, allowing selected fluid communication from the external selected fluid source 94 to the penetrating non coring cannula adapter aperture 50 onward to the penetrating non coring cannula lumen 44 and finally to the interior volume 35 of the reservoir assembly 22.

The materials of construction for the penetrating non coring cannula body 38, the penetrating non coring cannula adapter body 46, the penetrating non coring cannula adapter 53, and external selected fluid source 94 can be constructed of any material that is preferably compatible with the selected fluid 64.

In use the reservoir assembly 22 may be supplied to the user without the selected fluid 64, in other words the reservoir interior 35 would be emptied being devoid of the selected fluid 64. Alternatively, the reservoir assembly 22 may have the reservoir interior volume 35 sized to be filled or refilled with the selected fluid 64. In using the refillable fluid dispenser assembly 21 the user would first grasp the reservoir assembly 22 between the first end sealing cap 28 and the second end sealing cap and compress the resilient body portion 24 bellows 26 into a retracted position state between the resilient body portion first end 25 and the resilient body portion second end 31 with the result in a reduced reservoir interior volume 35 as shown in FIG. 16. Next, or secondly, the user inserts the penetrating non coring cannula adapter refill assembly 49 into the penetrable elastomeric member 36 and then attaches the external selected fluid source 94 and then engaging the applicator support element 88 if needed.

Further or thirdly, the user would manually place the resilient body portion 24 bellows 26 into the extended position state between the resilient body portion first end 25 and the resilient body portion second end 31 with the result in an increased reservoir interior volume 35. This will result in accomplishing the subsequent filling or refilling of the fluid dispenser assembly 21 for multiple uses of the fluid dispenser assembly 20. This may be with a single insertion of the penetrating non coring cannula adapter refill assembly 49 into the penetrable elastomeric member 36 or with multiple insertions and removals' of the penetrating non coring cannula adapter refill assembly 49 into and out of the penetrable elastomeric member 36, that would allow multiple refills of the reservoir assembly 22 reservoir interior volume 35. The resealing ability of the elastomeric member 36 helps to keep the selected fluid 64 from drying out or hardening in the reservoir assembly 22, and also helps in preventing spills and leakage of the selected fluid 64 from the reservoir assembly 22.

The refill fluid dispenser assembly 21 may be set up for multiple refills with a cleanable penetrating non coring cannula adapter refill assembly 49 or the use of multiple penetrating non coring cannula adapter refill assemblies 49 that are each individually disposable.

Method of Use

Referring back to FIGS. 8, 9, and 10 showing the fluid dispenser assembly 20 in use, the following method of using is given for the fluid dispenser assembly 20 for manually applying a selected fluid 64 to a desired location comprising various steps for a typical use of the fluid dispenser assembly 20. Firstly, providing a fluid dispenser assembly 20 that includes a reservoir assembly 66 containing the selected fluid 64, the reservoir assembly 66 also includes a resilient body portion 68 having a first end 69 and a second end 71, a first end sealing cap 28, and a second end sealing cap assembly 33 to define a reservoir interior 67. The body 68 having bellows that are defined by a plurality of angular segments each having a pair of sides that are of unequal length with a longer side 70 and a shorter side 72. The bellows are oriented to retract with the shorter side 72 of each pair being folded back under the longer side 70 resulting in the body 68 retracting between the first end 69 and the second end 71 with the body 68 maintaining its last selected retracted or extended position. The second end sealing cap assembly 33 includes a penetrable elastomeric member 36 and an applicator assembly 47 having a proximal end 98 and a distal end 100. The proximal end 98 includes a non coring cannula 38 with a lumen 44 having an insertion end 43 that is adapted to insert and penetrate through the elastomeric member 36 and protrude into the reservoir interior 67 enabling fluid communication between the reservoir interior 67 and the lumen 44. The distal end 100 includes an application element 62 that is in fluid communication with the lumen 44.

Secondly, positioning the application element 62 at the desired location of where to apply the selected fluid 64 by the user can include but is not limited to various surfaces, cavities, remote areas, volumes, and the like. Thirdly, manually retracting the reservoir body 68 a sufficient amount to initiate the selected fluid 64 to communicate from the reservoir interior 67 to the lumen 44 and onward to the application element 62. This is accomplished by manually by placing the user's thumb and forefinger on the first end sealing cap 28, and a second end sealing cap 30 respectively, and gently squeezing together the user's thumb and forefinger thus retracting the body 68 causing the selected fluid 64 to flow from the reservoir interior 67 and into the lumen 44 with the selected fluid 64 which is then deposited onto the application element 62 allowing application of the selected fluid 64 to the desired location. Fourth, the user applying the selected fluid 64 to the desired location by use of the application element 62. Fifth, retracting the reservoir body 68 further to a retracted position by a single angular segment pair causing the shorter side 72 of the pair being folded back under the longer side 70, with the body 68 maintaining the retracted position thus continuing the selected fluid 64 communication from the reservoir interior 67 to the lumen 44 and onward to the application element 62. The user would then sequentially repeat steps four and five until the selected fluid 64 has been completely applied to the desired location.

CONCLUSION

Accordingly, the present invention of a fluid dispenser has been described with some degree of particularity directed to the embodiments of the present invention. It should be appreciated, though, that the present invention is defined by the following claims construed in light of the prior art so modifications the changes may be made to the exemplary embodiments of the present invention without departing from the inventive concepts contained therein.

What is claimed is:

1. A fluid dispenser for manually applying a selected fluid to a desired location, comprising:

(a) a reservoir assembly that is able to contain the selected fluid, said reservoir includes a resilient body portion having a first end and a second end, a first end sealing cap, and a second end sealing cap assembly to define a reservoir interior, said body having bellows oriented to retract or extend said body between said first end and said second end to create a variable reservoir interior volume, said second end sealing cap includes a penetrable elastomeric member; and (b) an applicator assembly having a proximal end and a distal end, said proximal end includes a non coring cannula with a lumen having an insertion end that is adapted to insert and penetrate through said elastomeric member and protrude into said reservoir interior enabling fluid communication between said reservoir interior and said lumen, said distal end includes an application element that is in fluid communication with said lumen.

2. A fluid dispenser according to claim 1 wherein said non coring cannula and lumen further comprises an aperture that is oriented substantially transverse to a longitudinal axis of said lumen, said aperture and lumen are in fluid communication, said aperture is positioned within said insertion end to create a blunt solid nose on a tip of said insertion end with said lumen terminating inboard of said tip to prevent cutting and coring of said elastomeric member while said insertion end is inserted and penetrated through said elastomeric member forming a substantially fluid tight seal between said non coring cannula and said elastomeric member also enabling said elastomeric member to substantially reseal with said insertion end removed from said elastomeric member, and to substantially prevent elastomeric member core debris from lodging in said lumen.

3. A fluid dispenser according to claim 1 wherein said application element is a brush having a plurality of bristles.

4. A fluid dispenser according to claim 1 wherein said application element is constructed of an open celled foam element.

5. A fluid dispenser according to claim 1 wherein said application element is a nozzle element.

6. A fluid dispenser according to claim 1 wherein said lumen has a controlled inside diameter that is operational to control a flowrate of the selected fluid.

7. A fluid dispenser according to claim 1 further comprising an applicator support element secured between said reservoir assembly and said applicator assembly, said applicator support element is removably engagable with said non coring cannula.

8. A fluid dispenser according to claim 1 wherein said body is constructed of a resilient synthetic plastic.

9. A fluid dispenser according to claim 1 wherein said body is constructed of materials selected from the group consisting essentially of polyethylene, polypropylene, and polyurethane materials.

10. A fluid dispenser according to claim 1 wherein said cannula and said application element are separable pieces that are matingly engagable in a substantially fluid tight manner.

11. A fluid dispenser according to claim 10 wherein said cannula further comprises an adapter positioned opposite of said insertion end for matingly engaging in a substantially fluid tight manner an external selected fluid source wherein selected fluid communication from said external selected fluid source into said lumen and further selected fluid communication into said reservoir interior is accomplished by extending said body from a retracted state to an extended state thus filling said reservoir with the selected fluid from the external selected fluid source.

12. A fluid dispenser according to claim 1 further comprising a valve that is positioned to be in fluid communication between said lumen and said application element, said valve being normally urged to a closed state and yieldable to an open state when said valve is exposed to selected fluid flow from said lumen, wherein the selected fluid in said lumen then flows to said application element when said valve is in an open state, said valve is urged to return to the closed state at the termination of selected fluid flow from said lumen.

13. A fluid dispenser according to claim 12 wherein said valve includes resilient arcuate wall portions that are diametrically opposed to one another to define a common discharge passage therebetween and are normally urged in a radial inward direction against one another to substantially close said valve placing said valve in a closed state, wherein when said valve is exposed to selected fluid flow from said lumen said resilient arcuate wall portions are urged in a radially outward direction to separate to define a common discharge passage placing said valve in an open state allowing the selected fluid to flow from said lumen to said application element.

14. A fluid dispenser according to claim 1 wherein said reservoir interior volume is sized to be prefilled with the selected fluid for multiple uses and substantially sealed with said insertion end removed from said elastomeric member.

15. A fluid dispenser according to claim 1 wherein said reservoir interior volume is sized to be prefilled with the selected fluid for a single use and substantially sealed with said insertion end removed from said elastomeric member.

16. A fluid dispenser for manually applying a selected fluid to a desired location, comprising:

(a) a reservoir assembly that is able to contain the selected fluid, said reservoir includes a resilient body portion having a first end and a second end, a first end sealing cap, and a second end sealing cap assembly to define a reservoir interior, said body having bellows that are defined by a plurality of angular segments each having a pair of sides that are of unequal length with a longer side and a shorter side, said bellows are oriented to retract with said shorter side of each said pair being folded back under said longer side resulting in said body retracting between said first end and said second end with said body maintaining its last selected retracted or extended position to create a selectable reservoir interior volume, said second end sealing cap includes a penetrable elastomeric member; and (b) an applicator assembly having a proximal end and a distal end, said proximal end includes a non coring cannula with a lumen having an insertion end that is adapted to insert and penetrate through said elastomeric member and protrude into said reservoir interior enabling fluid communication between said reservoir interior and said lumen, said distal end includes an application element that is in fluid communication with said lumen.

17. A fluid dispenser according to claim 16 wherein said non coring cannula and lumen further comprises an aperture that is oriented substantially transverse to a longitudinal axis of said lumen, said aperture and lumen are in fluid communication, said aperture is positioned within said insertion end to create a blunt solid nose on a tip of said insertion end with said lumen terminating inboard of said tip to prevent cutting and coring of said elastomeric member while said insertion end is inserted and penetrated through said elastomeric member forming a substantially fluid tight seal between said non coring cannula and said elastomeric member also enabling said elastomeric member to substantially reseal with said insertion end removed from said elastomeric member, and to substantially prevent elastomeric member core debris from lodging in said lumen.

18. A fluid dispenser according to claim 16 wherein said application element is a brush having a plurality of bristles.

19. A fluid dispenser according to claim 16 wherein said application element is constructed of an open celled foam element.

20. A fluid dispenser according to claim 16 wherein said application element is a nozzle element.

21. A fluid dispenser according to claim 16 wherein said lumen has a controlled inside diameter that is operational to control a flowrate of the selected fluid.

22. A fluid dispenser according to claim 16 further comprising an applicator support element secured between said reservoir assembly and said applicator assembly, said applicator support element is removably engagable with said non coring cannula.

23. A fluid dispenser according to claim 16 wherein said body is constructed of a resilient synthetic plastic.

24. A fluid dispenser according to claim 16 wherein said body is constructed of materials selected from the group consisting essentially of polyethylene, polypropylene, and polyurethane materials.

25. A fluid dispenser according to claim 16 wherein said cannula and said application element are separable pieces that are matingly engagable in a substantially fluid tight manner.

26. A fluid dispenser according to claim 25 wherein said cannula further comprises an adapter positioned opposite of said insertion end for matingly engaging in a substantially fluid tight manner an external selected fluid source wherein selected fluid communication from said external selected fluid source into said lumen and further selected fluid communication into said reservoir interior is accomplished by extending said body from a retracted state to an extended state thus filling said reservoir with the selected fluid from the external selected fluid source.

27. A fluid dispenser according to claim 16 further comprising a valve that is positioned to be in fluid communication between said lumen and said application element, said valve being normally urged to a closed state and yieldable to an open state when said valve is exposed to selected fluid flow from said lumen, wherein the selected fluid in said lumen then flows to said application element when said valve is in an open state, said valve is urged to return to the closed state at the termination of selected fluid flow from said lumen.

28. A fluid dispenser according to claim 27 wherein said valve includes resilient arcuate wall portions that are diametrically opposed to one another to define a common discharge passage therebetween and are normally urged in a radial inward direction against one another to close said valve placing said valve in a substantially closed state, wherein when said valve is exposed to selected fluid flow from said lumen said resilient arcuate wall portions are urged in a radially outward direction to separate to define a common discharge passage placing said valve in an open state allowing the selected fluid to flow from said lumen to said application element.

29. A fluid dispenser according to claim 16 wherein said reservoir interior volume is sized to be prefilled with the selected fluid for multiple uses and substantially sealed with said insertion end removed from said elastomeric member.

30. A fluid dispenser according to claim 16 wherein said reservoir interior volume is sized to be prefilled with the selected fluid for a single use and substantially sealed with said insertion end removed from said elastomeric member.

* * * * *